US007376984B2

(12) United States Patent
Molter

(10) Patent No.: US 7,376,984 B2
(45) Date of Patent: May 27, 2008

(54) TOILET REFILL BYPASS DIVERTER

(76) Inventor: Dan E. Molter, 5306 Manatee Ave. West, Bradenton, FL (US) 34209

( * ) Notice: Subject to any disclaimer, the term of this patent is extended or adjusted under 35 U.S.C. 154(b) by 142 days.

(21) Appl. No.: 11/201,821

(22) Filed: Aug. 10, 2005

(65) Prior Publication Data

US 2007/0006372 A1 Jan. 11, 2007

Related U.S. Application Data

(63) Continuation-in-part of application No. 11/176,443, filed on Jul. 6, 2005, now abandoned.

(51) Int. Cl.
*E03D 1/00* (2006.01)

(52) U.S. Cl. ..... 4/415

(58) Field of Classification Search ..... 4/415; 137/441

See application file for complete search history.

(56) References Cited

U.S. PATENT DOCUMENTS

| | | | | |
|---|---|---|---|---|
| 3,999,226 | A * | 12/1976 | Wolf | 4/225.1 |
| 4,327,941 | A * | 5/1982 | Schoepe | 4/353 X |
| 5,134,729 | A * | 8/1992 | Shaw | 4/415 |
| 5,287,565 | A * | 2/1994 | Auman et al. | 4/415 |
| 6,295,660 | B1 | 10/2001 | Schuster | 4/353 |
| 6,385,788 | B1 * | 5/2002 | Wasielewski | 4/415 |
| 6,546,568 | B1 | 4/2003 | Schuster | 4/353 |
| 6,823,889 | B1 | 11/2004 | Schuster | 4/415 X |
| 6,837,264 | B1 | 1/2005 | Schuster | 137/434 |
| 2006/0080766 | A1 * | 4/2006 | Morales | 4/415 |

* cited by examiner

*Primary Examiner*—Robert M Fetsuga
(74) *Attorney, Agent, or Firm*—Curtis L. Harrington; Kathy E. Harrington; Harrington & Harrington

(57) ABSTRACT

A flow diverter accepts a stream of water from a conventional toilet valve and diverts a portion of the flow into the toilet tank, outside the overflow tube. In a first, more rudimentary embodiment of the invention, a flow diverter accepts flow from the toilet tank fill valve and includes a first exit opening for introducing a portion of the flow into the toilet tank overflow tube, and a second portion of the flow into the toilet tank. Providing two exit openings for to split the incoming stream into a first flow of about one third of the input and into a second exit opening to split the remainder of the incoming stream into a second flow of about two thirds of the incoming stream provides significant flow control for the user. In cases where a user's bowl overfills, the user can attach the flow diverter to the end of the conventional toilet tank overflow tube line and position it as needed. The user can (1) attach the diverter to the top rim of the conventional toilet tank overflow tube in a position to deliver one third of the flow into the tube and two thirds of the flow into the toilet tank, (2) attach the diverter to the top rim of the conventional toilet tank overflow tube in a position to deliver two thirds of the flow into the tube and one third of the flow into the toilet tank, (3) all of the flow into the tube or (4) all of the flow into the toilet tank.

1 Claim, 4 Drawing Sheets

TOILET REFILL BYPASS DIVERTER

This case is a continuation-in-Part of U.S. patent application Ser. No. 11/176,443 filed Jul. 6, 2005 now abandoned.

FIELD OF THE INVENTION

The present invention relates to the field of plumbing and bathroom appliances and more particularly to a quick and inexpensive retrofit system for saving water by prevention of toilet bowl overfill.

BACKGROUND OF THE INVENTION

Conventional flush toilets are typically supplied water through a line from a manually available shutoff valve, and into a valve apparatus inside the tank. Some valve mechanisms use a float mounted at the end of a lever arm while others use a vertically sliding float, while others use static water pressure to indicate when the flush tank or reservoir is full.

Within the tank an overflow tube is provided to enable small leaks of the internal valve, or small internal valve failures to enter the toilet tank overflow tube and pass to the toilet bowl. Since the toilet bowl flow operates by passing its volume over a static pressure head dam at the rear and or base of the toilet, additional flow into the overflow tube simply continues into the bowl and over the dam at the rear and base of the toilet.

The flow path from the bowl, through the dam and into the floor pipe fitting is relatively small compared to the volume of water in each flush. This rapid flow helps to sweep the bowl, but because the flow is restricted, a significant kinetic energy of flow takes the toilet bowl to a level lower than its level would be if it were determined by the height of the dammed up water within the toilet fixture. This kinetic energy drains the bowl level lower than it would have based upon the level of the overflow damn in the fitting, because the mass of flow and its kinetic energy continues to siphon water out of the bowl for a second or so at the end of the flush. This typically occurs along with the pull of air and the gargling sound heard when the upper part of the bowl is completely drained.

If the bowl was left at this level, the volume of water for the next flush would be partially spent in refilling the bowl and would have a lesser volume available to apply to the static head within the bowl to cause a complete flush in the next cycle. In essence, the next flush would be only half of a flush, and at low velocity. This results in the need for a further flush, assuming that the bowl is left in a filled state by the half flush.

To overcome the above problems, most toilet fill valves have provided for a first flow path of water into the toilet tank for refill and a second flow path through a small plastic tube mounted to direct flow into the toilet tank overflow pipe to provide a small stream of water to allow the toilet bowl to re-fill at the same time that the toilet tank refills. During refill, the bowl will have stabilized, and a stream of water into the overflow tube will bring the bowl fully up to a level of the internal dam or trap within the toilet bowl. This will insure that upon the next flush, that the complete volume of water in the toilet tank will be applied to developing a full static head to be applied to a fully rushing velocity flush so that the bowl will be swept clean. In other words, it prevents part of the toilet tank contents from being wasted in re-filling the bowl leaving a lesser amount of water available for developing a fully rushing velocity flush. If the system for providing additional water into the overflow tube provides too much water, the excess will escape over the dam or trap at the base of the appliance.

However, the use of a side stream of water from the refill valve is not exact. The side stream will have a low flow where the local water pressure is low and a high flow where the water pressure is high. Where the flow rate is too small, the complete valve assembly can be replaced in order to provide adequate functioning. With increasing community needs for water conservation there is a need to conserve water and for toilet appliance to provide only as much water as is needed for proper operation. The user needs to be at minimum able to forego excess water introduced into the bowl which will be wasted over the overflow dam.

One such solution proposed appears in U.S. Pat. No. 6,823,889 to Schuster, incorporated by reference herein. The Schuster reference suggests a more complex and more expensive specialized toilet valve which includes an adjustable pressure overflow tube line valve in the toilet tank valve body near the point where the overflow refill tube leaves the toilet tank valve. The overflow tube line valve is located within the toilet tank refill valve so that it can handle the pressure from reduction in the flow of the overflow tube line, which can range from full open to a zero flow rate. The solution, though expensive, enables users to set the flow rate for the amount of water to be introduced into the overflow tube. The user can reduce this refill flow by adjusting the valve.

This solution works well where users have the funds to invest in a new toilet tank fill valve, as well as the high labor rates associated with plumbing services. Further, some time is required for the installer to run the valve through several flushes to determine the optimum operating setting for the complex specialized device. Further, the replaced toilet tank refill valve will typically be disposed of despite the fact that it remains in operating condition. In particular, an institutional facility replacing its valves would generate a significant volume of used toilet tank refill valves having very little market value. The loss of value from a change out and in wasted valves would make the value of the water savings minuscule by comparison. The expensive solution of the Schuster reference may work well if employed as a replacement for a defective toilet tank but is prohibitively expensive and burdensome for any water saving retrofit plan.

What is needed, however, is a solution which is not expensive, not complex, and does not require replacement of the functioning toilet tank refill valve. The needed solution should give the user practical control ability over the amount of water entering the refill tube. Further, the solution should be installable in a minimum amount of time and by ordinary people. The installation should not, unlike a toilet tank valve replacement, subject the user's facility to flooding, water shutoff, leaks about the toilet tank fittings and the like. The needed solution should be achieved without tools.

SUMMARY OF THE INVENTION

A flow diverter accepts a stream of water from a conventional toilet valve and diverts a portion of the flow into the toilet tank, outside the overflow tube. In a first, more rudimentary embodiment of the invention, a flow diverter accepts flow from the toilet tank fill valve and includes a first exit opening for introducing a portion of the flow into the toilet tank overflow tube, and a second portion of the flow into the toilet tank. Providing two exit openings for to split the incoming stream into a first flow of about one third of the input and into a second exit opening to split the remainder of the incoming stream into a second flow of about two thirds of the incoming stream provides significant flow control for the user. In cases where a user's bowl overfills, the user can attach the flow diverter to the end of the conventional toilet tank overflow tube line and position it as needed. The user can (1) attach the diverter to the top rim of the conventional toilet tank overflow tube in a position to deliver one third of the flow into the tube and two thirds of the flow into the toilet tank, (2) attach the diverter to the top rim of the conventional toilet tank overflow tube in a position to deliver two thirds of the flow into the tube and one third of the flow into the toilet tank, (3) all of the flow into the tube or (4) all of the flow into the toilet tank.

Further numbers of diversion streams, and the ability to orient the flow diverter atop a toilet tank overflow tube will allow a user to more finely and exactly select and subdivide the streams which are to be directed into, or outside of the conventional toilet tank overflow tube. Where three diversion conduits are used, a user can specify a flow equal to zero, 1/5, 2/5, 3/5, 4/5, and 5/5 of the inlet flow. A metal clip can be molded with the flow diverter to provide more holding power than possible if the flow diverter is constructed with certain materials. The flow diverter is preferably inexpensively injection molded and can be made from a wide range of materials having many characteristics.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
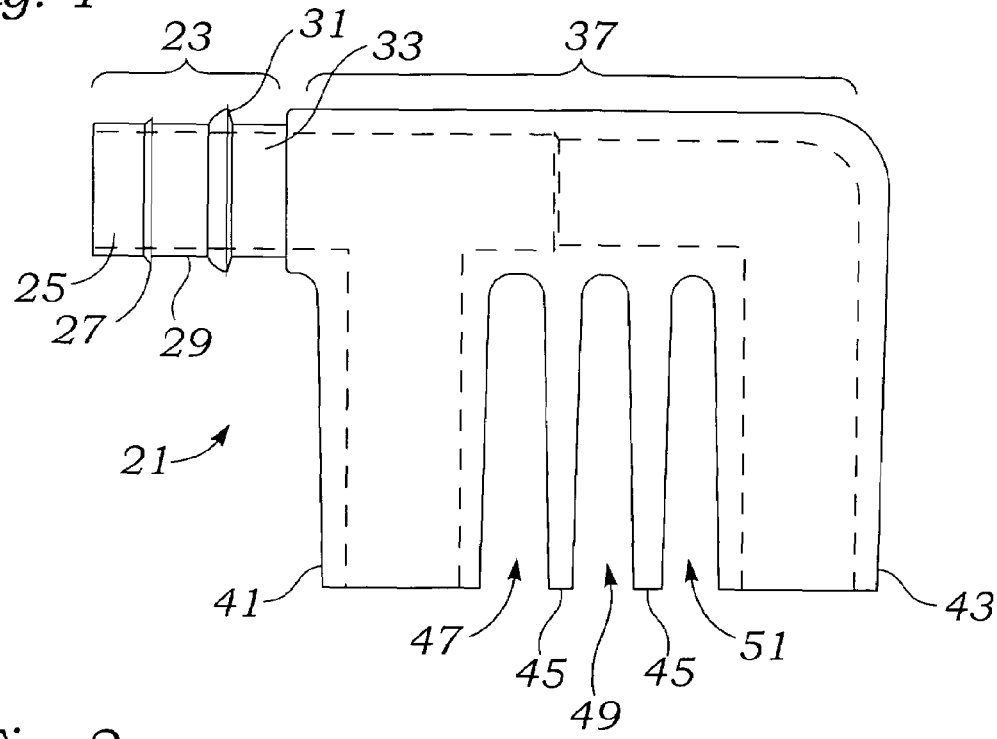
FIG. 1 is a side view of a two stream flow diverter having a male input port and two exit conduits and a clip holding structure.

The description and operation of the invention will be best initiated with reference to FIG. 1 which illustrates a side plan view of a flow diverter 21. At the upper left side of the flow diverter 21, an inlet fitting 23 has a length of about one half inch. The shape of the inlet fitting 23 is designed to provide good, progressive fit to an tubular member flexible conduit from a conventional toilet fill valve. Inlet fitting 23 has three cylindrical sections each separated from the other by two progressively larger abbreviated frusto conical structures.

From the left, a first cylindrical section 25 has an external diameter of, for example, 0.335 inches. Adjacent the first cylindrical section 25, a first frusto conical shaped land 27 extends circumferentially outward. Adjacent the frusto conical shaped land 27, a second cylindrical section 29 has an external diameter of 0.360 inches. Adjacent the second cylindrical section 29, a second frusto conical shaped land 31 extends circumferentially outward. The second frusto conical shaped land 31 may be larger than the first frusto conical shaped land 27. Adjacent the second frusto conical shaped land 31 is a third cylindrical section 33 which may also have an external diameter of 0.360 inches.

The inlet fitting 23 is designed to present an increasing slip fitting resistance pressure and increasing friction fit to a flexible hose attached. The body of the flow diverter 21 continues with a first flow section 37 which is linear with respect to the inlet fitting 23. At the start of the first flow section 37 adjacent and slightly displaced away from the inlet fitting 23 is a first diversion conduit 41. At the opposite end of the first flow section 37, a second diversion conduit 43 is positioned. In between the first and second diversion conduits 41 and 43 are one or more structures 45 which are clip structures. The clip structures shown in FIG. 1 are made generally of the same material as the flow diverter 21 and may be evenly space or non-evenly spaced. The clip structures 45 are both substantially continuous with, and substantially parallel to the diversion conduits 41,43 of, the diverter 21. The clip structures and the first and second diversion conduits 41 and 43 form a series of three accommodation spaces 47, 49, and 51 which may be of different widths and which can provide force and friction when engaged onto a toilet tank overflow tube. The rudimentary structure shown in FIG. 1 is built for an engagement on a toilet tank overflow tube such that one or the other of the first and second diversion conduits 41 and 43 will be directed into the tube. The flow diverter 21 can be placed so that either the first diversion conduit 41 will be inside the tube and the second diversion conduit 43 will be outside of the tube, or that first diversion conduit 41 will be outside the tube while the second diversion conduit 43 will be inside of the tube. The other two conditions, that of 100% of the fill tube flow being directed inside of the tube and 0% of the fill tube flow being directed inside of the tube is not as facilitated with this design. If no flow diverter 21 is used, it may be assumed that other structure is present to either direct 100% flow into the fill tube or that the fill tube line may be left in an unobstructed way to flow into the toilet tank without interfering with the flush mechanism.

Figure 2:
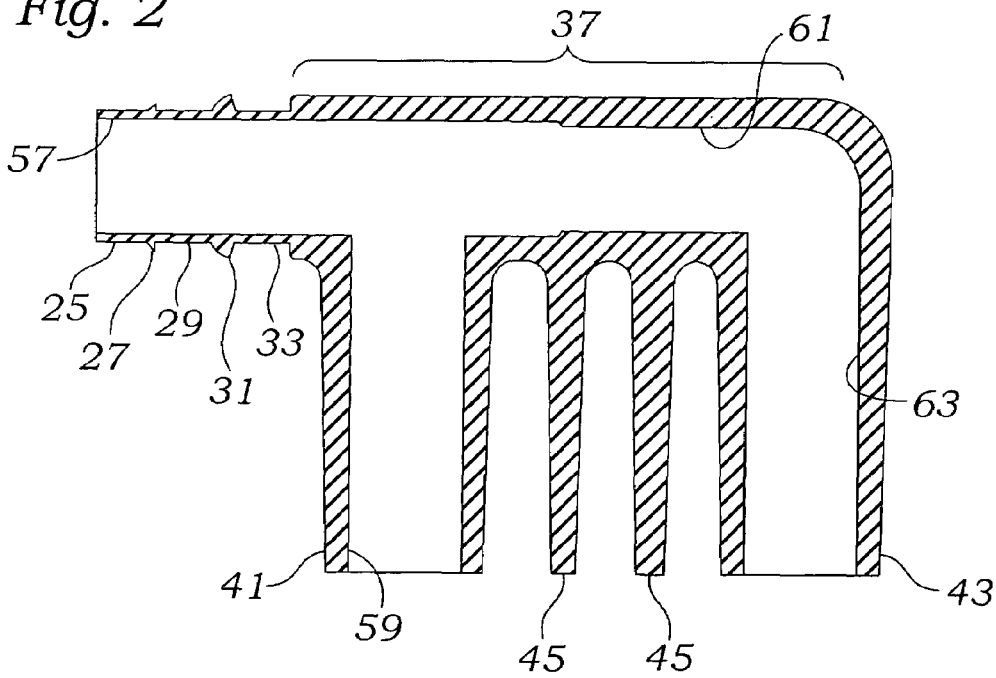
FIG. 2 is a side sectional view of the flow diverter of FIG. 1 and illustrating one possible orientation for the internal conduit bores.

Referring to FIG. 2, a side sectional view illustrates the internal flow space of the flow diverter 21, as a slightly differing embodiment having first cylindrical section 25 displaced by movement of the first frusto conical shaped land 27 to the end, simply to show that a different arrangement can be made. An inlet conduit bore 57 has a first diameter to a point just beyond a t-conduit bore 59 within the first diversion conduit 41. A second diameter is seen as conduit bore 61 which turns at a right angle to a conduit bore 63 associated with the second diversion conduit 43.

The relative flow through the conduit bores 59 and 63 from fluid entering the inlet conduit bore, can be specified by the abruptness of angle, location, difference in internal bore size, and curvature and internal features of bores 57, 59, 61, and 63. Moreover, the size of all the bores 57, 59, 61, and 63 should be so as to avoid creating any significant back pressure for any flow line into which inlet fitting 23 is attached. Further, it is noted that first and second diversion conduits 41 and 43 are parallel to each other, but need not be. The parallel arrangement seen in FIGS. 1 and 2 have advantages in that if one of the, first and second diversion conduits 41 and 43 placed outside the toilet tank overflow tube is directed downward, that the flow will contribute to sweeping the toilet tank clean. Conversely, where a significant flow rate of material exits the first and second diversion conduits 41 and 43, thrust will result in the opposite direction. This thrust may tend to dislodge the flow diverter 21 from its slip fit onto the toilet tank overflow tube via the three accommodation spaces 47, 49, and 51.

The dimensions of the flow diverter 21 are approximate and a flow diverter 21 having a higher flow or a lower flow may encourage a differing dimension. As seen in FIG. 2, the water available to enter bore 59 will do so based upon the cross sectional area of exit presented, the angle and sharpness as related to the path of flow of water entering the conduit 57, and the kinetic energy of the remaining water stream as it flows past conduit 59 and onward into conduit 61. The relative flow split is also dependent upon the much longer flow path of the combined path of conduits 61 and 63 and the elbow connection between these conduits.

One geometry which has been shown to be acceptable for a given average flow includes a flow diverter 21 having a conduit bore 57 diameter of about 0.25 inches and sharply connecting orthogonally to a conduit bore 59 also having an internal diameter of about 0.25 inches. The diameter of conduit bores 61 and 63 are about 0.225 inches. With these dimensions it has been shown that the volume of flow through the first diversion conduit 41 will constitute about one-third of the total input volume, while the volume of flow through the second diversion conduit 43 will constitute about two-thirds of the total input volume. It is understood that small changes to the internals, including the placement of the transition between bores 57 and 61 and other design changes can affect the relative flow rates. For the rudimentary case of one stream being split into two, the two-thirds/one-third ratio is believed to give the user the most ease and flexibility at making a relatively easy to observe and measure.

The outer diameter of the first cylindrical section 25 of the inlet fitting 23 is about 0.335 inches. While the largest dimension of the second frusto conical shaped land 31 is about 0.36 inches. This breadth of available fit should enable the flow diverter 21 inlet fitting to form a good tight fit on flexible tubing having an inner diameter of from about slightly smaller than 0.25 inches and up to and including tubing having an inner diameter of up to 0.36 inches. In the event of a mismatch, an adapter could be used. A smaller toilet tank overflow fill tube line 87 would be preferable as the dimensions of the flow diverter 21, and particularly the diameter of the bores 57, 59, 61, and 63, should not cause a restriction which will be powerful enough to either cause the flow diverter 21 to become disconnected from the toilet tank overflow fill tube line 87 nor to create a thrust in the flow diverter 21 sufficient to cause it to become disconnected from the toilet tank overflow tube 89. An oversized flow diverter 21, with respect to the toilet tank overflow fill tube line 87 is generally encouraged.

Figure 3:
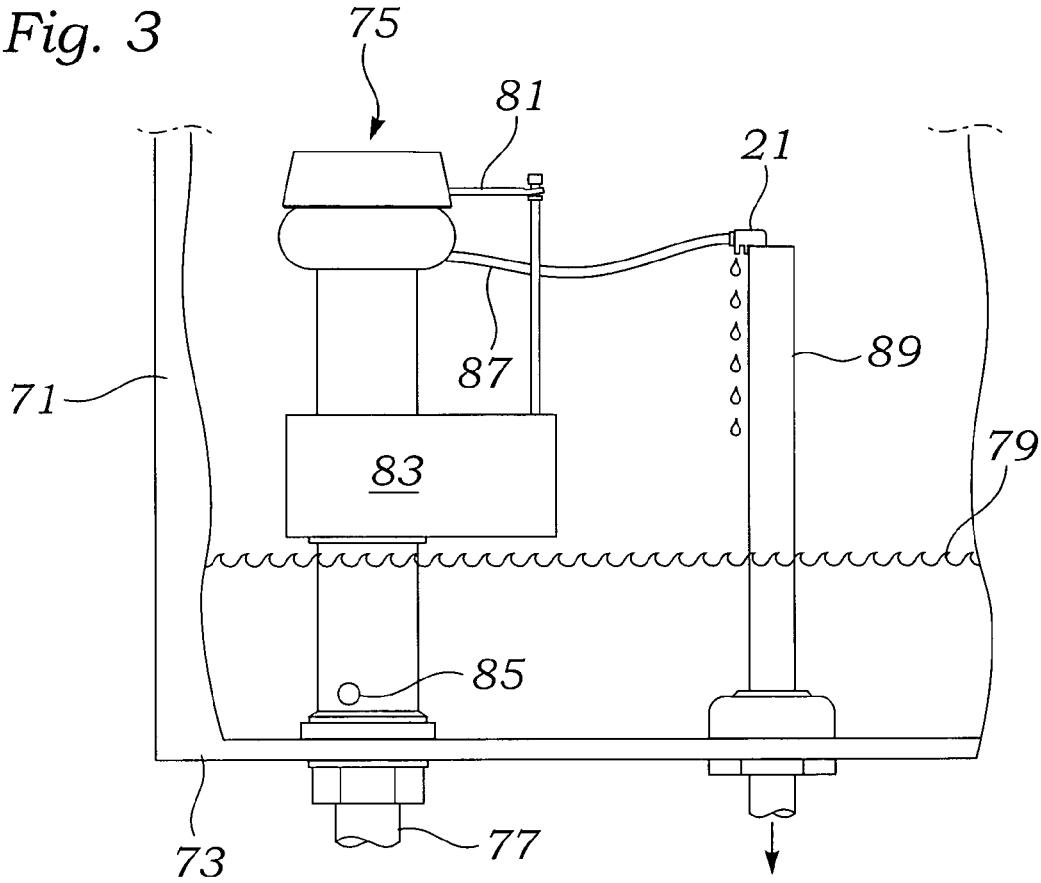
FIG. 3 illustrates a partial sectional view illustrating the environment in which the flow diverters of the present invention are utilized and illustrating attachment of the flow diverter attached to a near side of a toilet tank overflow tube.
Figure 4:
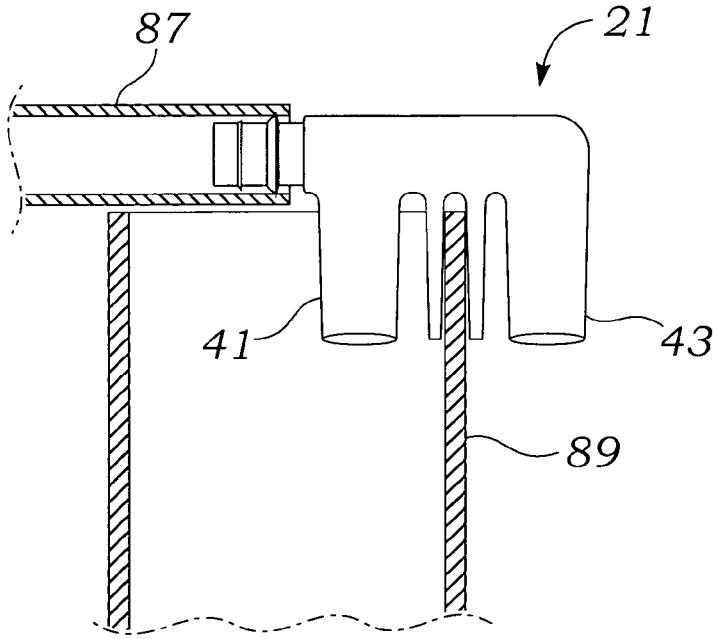
FIG. 4 illustrates an expanded view of a mounting of the flow diverters of the present invention are utilized and illustrating attachment of the flow diverter attached to a far side of a toilet tank overflow tube.

In the view of FIG. 3, a partial broken away view illustrates a toilet tank 71 havina a toilet tank floor 73, toilet tank fill valve assembly 75, inlet pipe 77, toilet tank water level 79, toilet tank valve shutoff arm 81 and a float 83, and an outlet 85 located lust above the toilet tank floor 73. As shown, the flow diverter 21 was attached to the toilet tank overflow fill tube line 87 such that second diversion conduit 43 was inside it and delivering two-thirds of the flow within, while first diversion conduit 41 was outside, delivering one-third of the flow outside. Referring to FIG. 4, an alternative partial sectional view showing a different positioning shows the flow diverter 21 attached to the toilet tank overflow fill tube line 87 such that first diversion conduit 41 was inside it and delivering one-third of the flow within, while the second diversion conduit 43 was outside, delivering two-thirds of the flow outside of toilet tank overflow fill tube line 87 and into the toilet tank 71 in contribution to the toilet tank water level 79.

Figure 5:
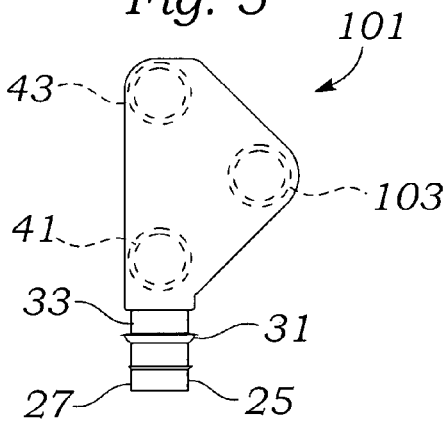
FIG. 5 is a top view of a flow diverter utilizing a side leg structure similar to the adjacent flow diverter structures, the location of three such adjacent structures facilitating the circularly selectable positioning of the flow diverter.
Figure 6:
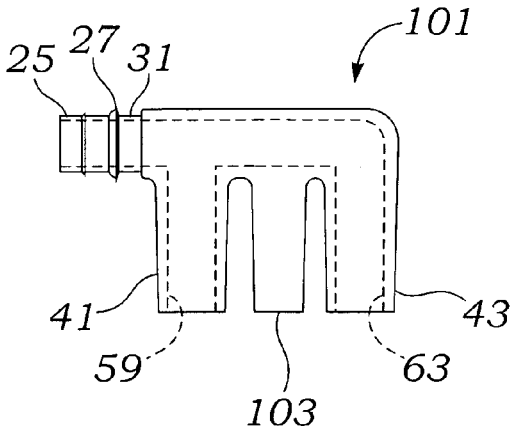
FIG. 6 is a side view of the flow diverter seen in FIG. 5.

Other configurations of a flow diverter 21 can give further flexibility of mounting. Referring to FIG. 5, a flow diverter 101 has essentially the same flow arrangement as flow diverter 21, but is formed with a side leg 103 which can form an engagement with the rim of an object placed between side leg 103 and the first and second diversion conduits 41, between first diversion conduit 41 and the second diversion conduit 43 and the first diversion conduit 41 and side leg 103. The side leg 103 is preferably solid and carries no flow. The side leg 103 is, like clip structures 45, simply a holding structure to assist in attachment to toilet tank overflow tube 89. In the embodiment of FIG. 6, the first and second diversion conduits 41 and 43 and side leg 103 may preferably be tapered or step tapered in order to form a better fit. In this configuration, all, none, one or two flow streams may be directed into the toilet tank overflow tube 89.

Figure 7:
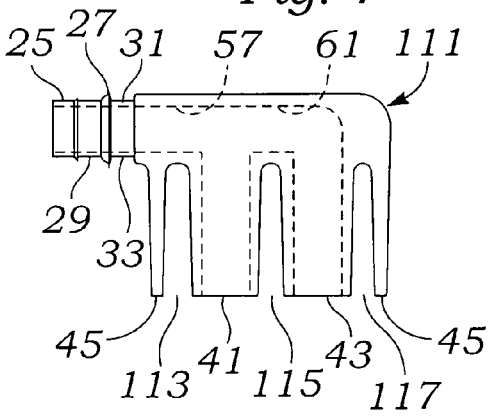
FIG. 7 is an alternative arrangement seen as a third embodiment in which a pair of diversion conduits are separated by an accommodation space and in which end mounted clip structures are placed on either side of the pair of diversion conduits enable full user selectability of four flow conditions into a toilet tank overflow tube.

Referring to FIG. 7, a further embodiment is seen as a flow diverter 111 which, like the flow diverter 111, has the ability to be mounted so that all, none, one or two flow streams may be directed into the toilet tank overflow tube 89. Placement of the two clip structures 45 on the outside of the first and second diversion conduits 41 and 43, and providing three accommodation spaces 113, 115, and 117, with space 113 between a clip structure 45 and first diversion conduit 41, space 117 between a clip structure 45 and second diversion conduit 43, and space 115 between first and second diversion conduits 41 and 43. This permits the flow diverter 113 to be placed on the near edge of a toilet tank overflow tube 89 so that the flow is all outside the tube, one stream inside, or two streams are inside the tube. Where the stream from first diversion conduit 41 is desired to flow into the toilet tank overflow tube 89, the space 115 is simply fitted over the far wall of the toilet tank overflow tube 89 such that first diversion conduit 41 is oriented to send its flow into the toilet tank overflow tube 89.

Figure 8:
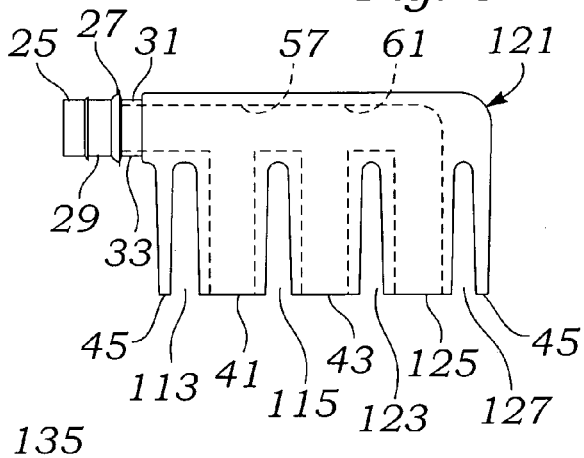
FIG. 8 is a fourth embodiment of a flow diverter having three diversion conduits in a line and in which end mounted clip structures are placed on either side of the pair of diversion conduits enable full user selectability of up to six flow conditions into a toilet tank overflow tube.

The orientation and flexibility of flow diverter 111 can be expanded to longer versions having, for example one more flow conduit, and the next integer number ratio of flow. Three conduits may ideally have flows of ¼, ¼, and ½ to enable selection of flow into the toilet tank overflow tube 89 of ¼, ½, ¾, and full flow. In the configuration of flow diverter 111, an additional conduit and clip set are all that need to be added. This is seen in FIG. 8 where a flow diverter 121 has one additional diversion conduit and one additional accommodation space.

Flow diverter 121 second diversion conduit 43 is followed by an accommodation space 123 and then followed by a third diversion conduit 125. The third diversion conduit is then followed by an accommodation space 127. Any of the accommodation spaces 113, 115, 123, or 127 can fit over the rim of a toilet tank overflow tube 89. The selectability of three flow conduits can be demonstrated by example.

With regard to the flow diverter 121, where first and second and third diversion conduits 41, 43, & 125 are employed, second and third diversion conduits 43 and 125 can each have a flow of ¼ of the total flow with first diversion conduit 41 having a flow of ½ of the total. As the flow diverter approaches the toilet tank overflow tube 89, the accommodation clot 127 could be attached to the upper rim of tube 89 to cause all of the flow to go outside, into the toilet tank 71. Moving the flow diverter 121 to attach at accommodation space 123 would cause ¼ of the flow to go inside the toilet tank overflow tube 89 with the remainder into the toilet tank 71. Moving the flow diverter 121 to attach at accommodation space 115 would cause ½ of the flow to go inside the toilet tank overflow tube 89 with the remainder into the toilet tank 71.

Moving the flow diverter 121 across the toilet tank overflow and to attach to the opposite side of the toilet tank overflow tube 89 at accommodation space 123 will cause ¾ of the flow to go inside the toilet tank overflow tube 89 (from first and second diversion conduits 41 and 43, with the remainder of the flow via third diversion conduit 125 to flow into the toilet tank 71. As can be seen from this case, the use of accommodation space 115 splits the flow, and for finer flow adjustability, the flow openings of the first and second and third diversion conduits 41, 43, & 125 should be selected for an uneven split.

By further example, if increments of ⅕ were selected, and with regard to the flow diverter 121, where first and second and third diversion conduits 41, 43, & 125 are employed, second and third diversion conduits 43 and 125 can each have a flow of ⅕ of the total flow with first diversion conduit 41 having a flow of ⅗ of the total. As the flow diverter approaches the toilet tank overflow tube 89, the accommodation clot 127 could be attached to the upper rim of tube 89 to cause all of the flow to go outside, into the toilet tank 71. Moving the flow diverter 121 to attach at accommodation space 123 would cause ⅕ of the flow to go inside the toilet tank overflow tube 89 with the remainder into the toilet tank 71. Moving the flow diverter 121 to attach at accommodation space 115 would cause ⅖ of the flow to go inside the toilet tank overflow tube 89 (from second and third diversion conduits 43 and 125 flowing at ⅕ each) with the remainder into the toilet tank 71.

Moving the flow diverter 121 across the toilet tank overflow and to attach to the opposite side of the toilet tank overflow tube 89 at accommodation space 115 will cause ⅗ of the flow to go inside the toilet tank overflow tube 89 (from first diversion conduit 41) with the remainder of the flow via third and fourth diversion conduits 43 and 125 to flow into the toilet tank 71.

Moving the flow diverter 121 across the toilet tank overflow and still at the opposite side of the toilet tank overflow tube 89 at accommodation space 123 will cause ⅘ of the flow to go inside the toilet tank overflow tube 89 (from first and second diversion conduits 41 & 43), with the remainder of the flow via third diversion conduit 125 to flow into the toilet tank 71. Moving to the accommodation space 113 in a near orientation, or accommodation space 127 in a far orientation would cause all of the flow to enter the toilet tank overflow tube 89. As can be seen, the use of three linear diversion conduits can produce 7 flows, namely zero, ⅕, ⅖, ⅗, 4,5, and ⅘ of flow to be selectability placed in either the toilet tank overflow tube 89 or the toilet tank 71. Moreover, the use of a larger number of diversion conduits not only gives the user increased selectability in terms of flow, but also reduces any tendency of the flow diverter to produce thrust which might cause it to be dislodged from its position atop the toilet tank overflow tube 89.

Figure 9:
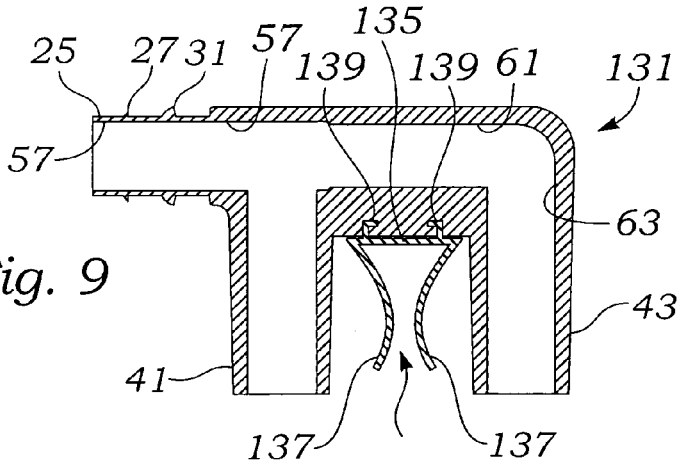
FIG. 9 is a side sectional view of a fifth embodiment of a flow diverter having an embedded metal clip between two flow conduits.

Referring to FIG. 9, a Fifth embodiment is seen as a flow diverter 131. Flow diverter 131 has a metal clip 133 which may be attached as the flow diverter 131 is injection molded. Clip 133 has a base 135 from which two metal members 137 extend. The metal members may be curved to facilitate mounting to the upper rim of toilet tank overflow tube 89. Metal clip 133 may have one or more anchoring structures 139 to enable it to hold fast within the flow diverter 131. The use of a flow diverter 131 with a metal clip 133 enables the use of a much larger and stronger holding device, regardless of the plastic or elastomer from which the flow diverter 21, 101, 111, 121, 131 is made. Further, none of the flow diverters 21, 101, 111, 121, 131 are shown to scale, and it is contemplated that a clip can have an expanded volume, length or other characteristic.

Figure 10:
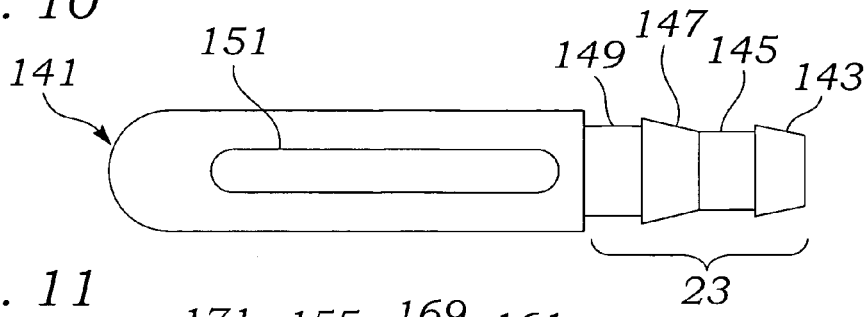
FIG. 10 is a top view of a sixth embodiment of a flow diverter having two frusto conical segments on its inlet fitting.

Referring to FIG. 10 a top view of a sixth embodiment of a flow diverter 141 having two frusto conical segments on its inlet fitting is shown. Flow diverter 141 has a first frusto-conical section 143 followed by a short conical section 145, followed by a second frusto-conical section 147, which is followed by a conical section 149 which is larger than conical section 145.

An oval flattened area 151 is provided to facilitate the reading of information which may include part numbers, specifications, origin of manufacture or other information.

Figure 11:
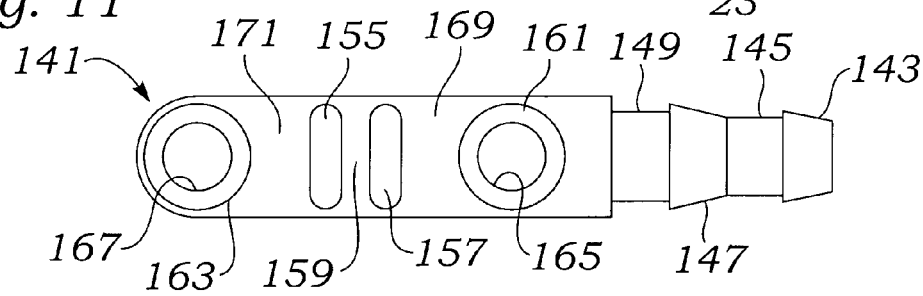
FIG. 11 is a bottom view of the sixth embodiment seen in FIG. 10.

Referring to FIG. 11, a bottom view of the flow diverter 141 illustrates a pair of clip structures 155 and 157 separated by a space 159. A first diversion conduit 161 is closer to the inlet fitting 23 and a second diversion conduit 163 is farther from the inlet fitting 23. First diversion conduit 161 has a larger internal diameter bore 165 than an internal diameter bore 167 of second diversion conduit 163. Note that the pair of clip structures 155 and 157 are slightly closer to the conduit 163 than to the conduit 161 to provide two different sized interspace areas 169 and 171.

Figure 12:
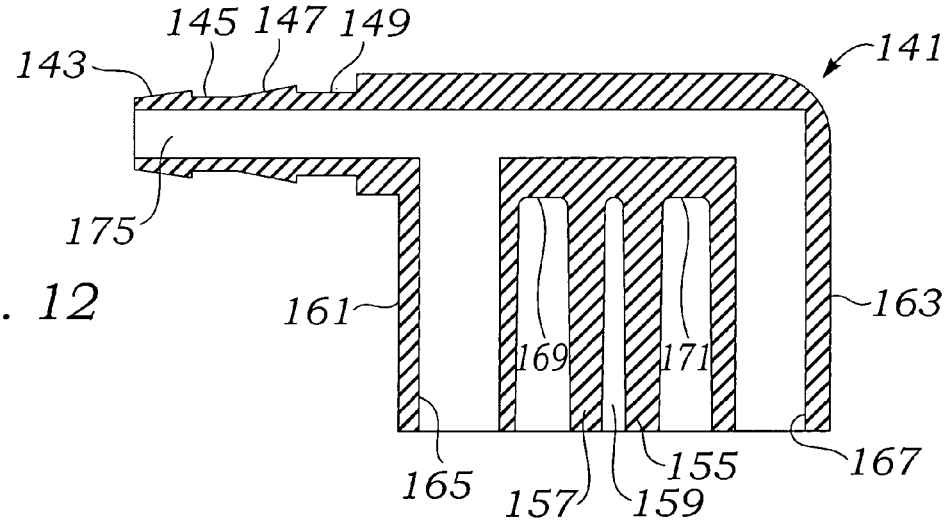
FIG. 12 is a side sectional view of the sixth embodiment seen in FIGS. 10 and 11.

Referring to FIG. 12, a side sectional view of the flow diverter 141 illustrates a constant cross section inlet bore 175 which extends linearly through an upper portion of the flow diverter 141. The turn from the constant cross section inlet bore 175 to the larger internal diameter bore 165 is abrupt, as is the turn from the constant cross section inlet bore 175 to the smaller internal diameter bore 167.

The sharp transition from bore 175 to bore 167 mitigates the effect of kinetic energy of the water flowing through the bore 175. This sharp transition results in more pressure drop downstream of the transition from bore 175 to bore 165, downstream and toward the transition from bore 175 to 165. Further, where the bore 165 is set to a diameter of about 0.250 inches and where bore 167 is set to a diameter of about 0.225 inches, the majority of the flow will occur through conduit 165. The inlet bore 175 is about 0.217 inches. With these dimensions, the flow diverter passes about forty percent of the flow through the conduit 163 and about sixty percent of the flow through the conduit 165.

The ability to set differing internal structures and differing internal diameters both for the inlet bore 175 and the exit bores 165 and 167. Where a relative pressure drop between the exit bores of any of the embodiments in FIGS. 1-14 is allowed to dominate, the exit volumes of the flow diverters flow diverter 21, 101, 111, 121, 131, 141 can be made to vary based upon flow. Sharper, more abrupt flow direction changes tend to create more back pressure with greater flow, where as more kinetic energy conserving structures tend to maintain flow through a bore with increasing flow.

As a result, a flow diverter can be designed which has a change in relative flow between two or more exit conduits with the flow rate. In this case, a particular diverter 21, 101, 111, 121, 131, 141 can be provided along with a chart which gives the relative flow rates between two exit conduits based upon flow. One advantage possible with this knowledge might include the selection of different sized diverter 21, 101, 111, 121, 131, 141 based upon the flow. Where an installer measures the flow rate per minute available, a chart can be referenced which would give the relative diverted flow for a given model of diverter 21, 101, 111, 121, 131, 141. This would enable an installer equipped with only a few sizes of the diverter 21, 101, 111, 121, 131, 141 to use the one with the closest approximation to the volume of water which needs to be diverted into the toilet tank 71.

Flow diverter 141 also illustrates the use of a smaller inlet bore 175 than the size of either of the exit bores 165 or 167. This structure favors a diversion split based more upon relative exit conduit size rather than flow. A throat structure in a main conduit as was seen in FIG. 2 where an upstream bore 57 is larger than a downstream bore 61 tends to create a flow resistance based more upon flow rather than the size of the exit conduits. So, a design for which flow dependent split is desired might include a large inlet bore relative to the outlet bores, a throat in the main inlet bore downstream of the first exit bore, and a sharp transition between the inlet bore and the final exit bore. A design for which the split in flow is to be more independent of the flow rate will include a small inlet bore relative to the outlet bores, no throat in the main inlet bore downstream of the first exit bore, and a curved transition between the inlet bore and the final exit bore.

Figure 13:
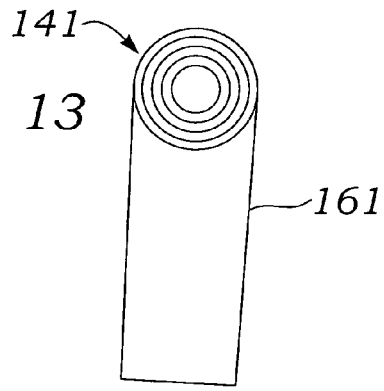
FIG. 13 is a view looking into the inlet fitting of the sixth embodiment seen in FIGS. 10-12.
Figure 14:
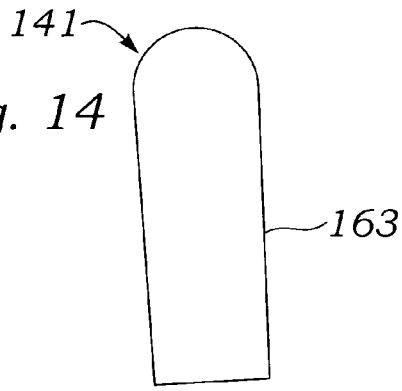
FIG. 14 is a view looking into the side of the sixth embodiment opposite the inlet fitting, the sixth embodiment also seen in FIGS. 10-13.

Referring to FIG. 13, a view looking into the inlet fitting 23 of flow diverter 141 is seen. Referring to FIG. 14, a view illustrating the second diversion conduit 161 is seen.

While the present invention has been described in terms of a flow diverter for a toilet tank overflow tube fill line, the principles contained therein are applicable to other types of selectable flow diversion systems.

Although the invention is derived with reference to particular illustrative embodiments, many changes and modifications of the invention may become apparent to those skilled in the art without departing from the spirit and scope of the invention. Therefore, included within the patent warranted hereon are all such changes and modifications as may reasonably and properly be included within the scope of this contribution to the art and which may be reasonably envisioned.

What is claimed is:

1. A single piece flow diverter for use with a toilet fill valve having a toilet tank overflow tube fill line and comprising:

a fluid inlet having an inlet fitting for fitting within a toilet tank overflow tube fill line for accepting a flow of water in addition to the main flow of water for filling a toilet tank said inlet fitting having a first frusto-conical shaped land and a second frusto-conical shaped land spaced apart from said first frusto-conical shaped land and farther from said fluid inlet than said first frusto-conical shaped land, said second frusto-conical shaped land having a lesser maximum radial diameter than said first frusto-conical shaped land;

a first diversion conduit, having a first tapered exterior, said first diversion conduit in fluid communication with said fluid inlet for diverting a first portion of fluid entering said fluid inlet;

a second diversion conduit, having a second tapered exterior, said second diversion conduit in fluid communication with said fluid inlet for diverting a second portion of fluid entering said fluid inlet, said first and said second diversion conduits have an even internal cross sectional area along their lengths, said first and said second diversion conduits separated from each other;

at least a pair of substantially parallel holding structures, adjacent one of said first and said second diversion conduits and continuous with said flow diverter and extending substantially coextensive with and parallel to at least one of said first and said second diversion conduits to facilitate affixing said flow diverter adjacent said upper edge of a toilet tank overflow tube; sufficient that said flow diverter may be press fit onto an upper edge of a toilet tank overflow tube utilizing at least one of said first and said second tapered exteriors, one of said parallel holding structures, in contact with said toilet tank overflow tube such that said flow diverter is stably attachable to said may be fixed with respect to said toilet tank overflow tube.

* * * * *